United States Patent [19]

Ebbrell

[11] 3,930,590

[45] Jan. 6, 1976

[54] STORAGE INSTALLATION FOR LIQUEFIED GAS

[75] Inventor: Harold K. Ebbrell, Chester, England

[73] Assignee: Shell Oil Company, Houston, Tex.

[22] Filed: Nov. 7, 1974

[21] Appl. No.: 521,806

[30] Foreign Application Priority Data

Dec. 4, 1973 United Kingdom ..... 56175/73

[52] U.S. Cl. ..... 220/9 LG; 62/45; 220/18

[51] Int. Cl.[2] ..... F65D 25/18

[58] Field of Search ..... 62/45; 220/9 LG, 18; 61/.5

[56] References Cited

UNITED STATES PATENTS

| | | | |
|---|---|---|---|
| 3,047,184 | 7/1962 | Van Bergen et al. | 220/9 LG |
| 3,407,606 | 10/1968 | Khan et al. | 62/45 |
| 3,791,164 | 2/1974 | Laverman | 220/9 LG |
| 3,852,973 | 12/1974 | Marothy | 62/45 |

*Primary Examiner*—William F. O'Dea
*Assistant Examiner*—Ronald G. Capossela
*Attorney, Agent, or Firm*—Ronald R. Reper

[57] ABSTRACT

In a storage installation for liquefied gas in a storage vessel surrounded by a wall which forms a collecting space around the vessel, the surfaces of the ground of the collecting space and/or the wall comprise a layer of a heat insulating material, whereby any liquefied gas collected in said collecting space evaporates more slowly thereby reducing hazard from gas vaporized in said collecting space.

3 Claims, 5 Drawing Figures

FIG. 1
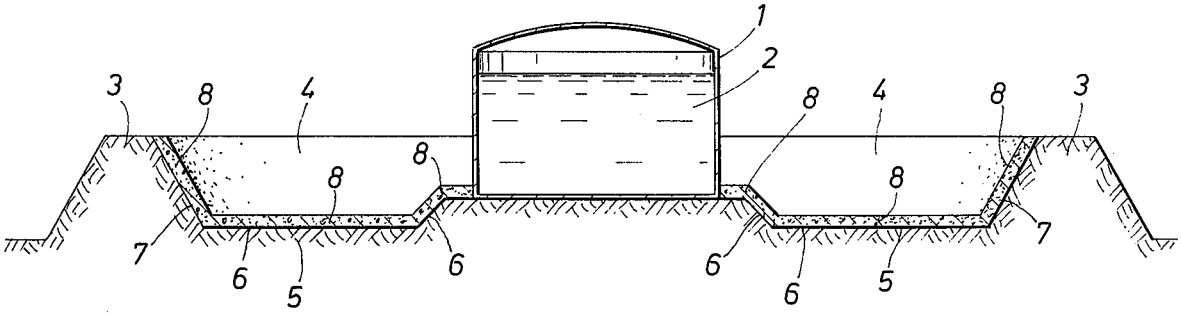
FIG. 2
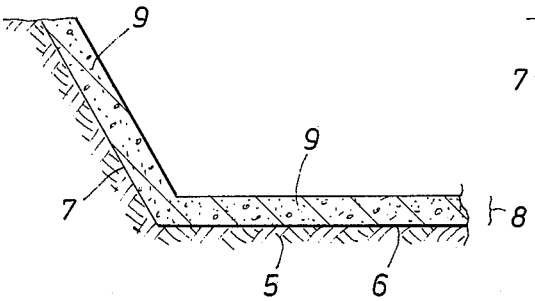
FIG. 3
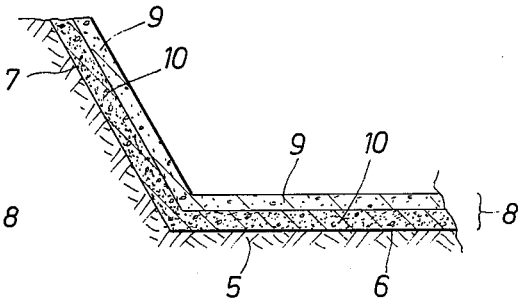
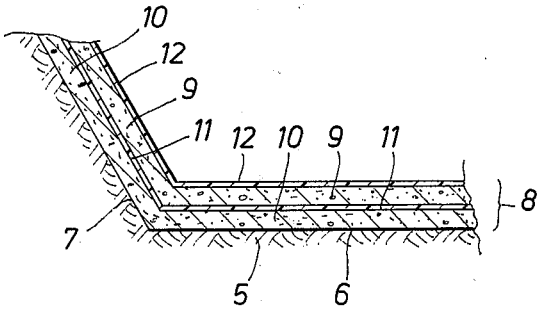
FIG. 4
FIG. 5
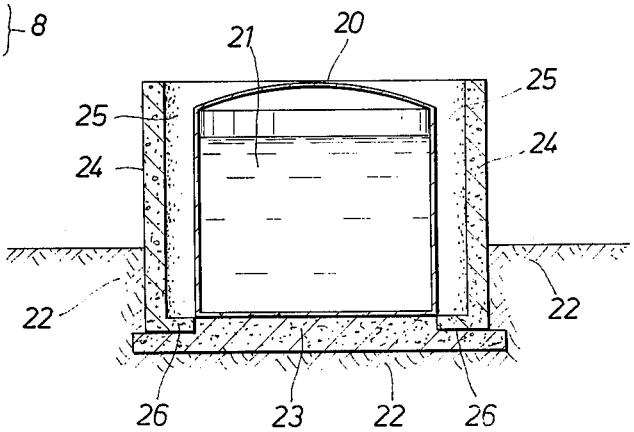

STORAGE INSTALLATION FOR LIQUEFIED GAS

BACKGROUND OF THE INVENTION

This invention relates to a storage installation for the storage of liquefied gas, and particularly liquefied natural gas.

More particularly, the invention relates to such a storage installation comprising a storage vessel surrounded by a wall or dam in such a manner that a collecting space is formed around the vessel. The main object of this collecting space is, in the event of damage to the tank or lines, to prevent the contents of the vessel from flowing away, by containing leaking liquefied gas in the said collecting space. This reduces the danger, of for example fire, to adjacent vessel or installations or to persons present in the vicinity.

A relatively important source of danger remains, however, in the event of leakage of liquefied gas caused by damage to vessel or lines. When the cold liquefied gas flows into the collecting space, it will suddenly absorb a large quantity of heat from the environment, thus causing the escaping liquefied gas to evaporate very rapidly. As a result a very large, concentrated cloud of gas could be formed very suddenly. This large, very rapidly forming inflammable cloud of gas increases the danger, of for example explosion or fire, even at a relatively large distance from the tank.

In addition to the quantity of liquefied gas flowing into the collecting space, the major factors determining the rate of formation, size and concentration of the gas cloud are the quantity of heat present in the vicinity which can flow to the liquefied gas and the rate at which heat can flow.

An important source of available heat is the ground of the collecting space and the wall or dam surrounding the collecting space.

SUMMARY OF THE INVENTION

This invention relates to an installation for the storage of liquefied gas comprising a vessel for liquefied gas surrounded by a wall or dam which forms a collecting space around the tank, wherein the surface of the ground of at least one of the collecting space and the wall of the collecting space comprise(s) a heat-insulating material. The preferred heat insulating material is lightweight concrete.

BRIEF DESCRIPTION OF THE DRAWINGS

FIG. 1 shows a diagrammatic cross-sectional elevation of a storage installation according to the invention;

FIG. 2 shows a diagrammatic cross-section of a part of an embodiment of the insulation according to the invention;

FIG. 3 shows a diagrammatic cross-section of a part of a second embodiment of the insulation according to the invention;

FIG. 4 shows a diagrammatic cross-section of a part of a third embodiment of the insulation according to the invention;

FIG. 5 shows a diagrammatic cross-sectional side elevation of an alternative storage installation according to the invention.

DETAILED DESCRIPTION OF INVENTION

It will be understood that a wide variety of heat-insulating materials may be considered for the purpose of reducing the flow of heat from the ground of the collecting space to any spilt liquefied gas. However, most suffer either from being too expensive in the large quantities needed to line such an area or are structurally unsuitable, for example they will not retain liquids or they will not support the weight of men or machines which might require to approach the tank during normal maintenance and use.

We have found that a most suitable heat-insulating material with which to insulate the wall or dam surrounding a tank in a storage installation, for the storage of liquefied gas, and/or the ground of the collecting space formed within the said wall or dam, is a lightweight concrete material. The lightweight concrete may have a density in the range from about 320 Kg per cubic meter to 1840 Kg per cubic meter and preferably from about 800 to about 1600 Kg per cubic meter.

Normal dense concrete having a typical density between 2160 to 2400 Kg per cubic meter is made from a coarse aggregate (usually rock chippings) held together by a mixture of fine aggregate (usually sand) and cement powder. By modifying normal dense concrete a light-weight concrete can be produced.

Lightweight concrete is lighter than normal dense concrete and basically it is the inclusion of air into its composition which makes it light. Lightweight concretes have low thermal conductivities and are therefore very suitable for insulating purposes.

The inclusion of air into the composition of the concrete can be achieved in three distinct ways:

a. by omitting the finer sizes from the aggregate grading thereby creating the so-called "no-fines concrete";
b. by substituting the gravel, or gravel and sand aggregates by a hollow or cellular aggregate which thereby includes air into the mix, so-called "lightweight aggregate concrete";
c. by creating gas bubbles in the cement slurry which on setting leaves a sponge-like cellular structure, so-called "aerated concrete".

A wide range of lightweight aggregates and aerating techniques are available for the development of these three types of lightweight concrete; these are shown in the following table:

TABLE

| Groups of lightweight concrete | | | | | | | |
|---|---|---|---|---|---|---|---|
| No-fines concrete | | Lightweight aggregate concrete | | Aerated concrete | | | |
| (1) | Gravel | (1) | Clinker | | Chemical aerating | | Foaming mixture |
| (2) | Crushed stone | (2) | Foamed slag | | | | |
| (3) | Coarse clinker | (3) | Expanded clay | (1) | Aluminium powder method | (1) | Preformed foam |
| (4) | Sintered pulverized | (4) | Expanded shale | (2) | Hydrogen peroxide and | (2) | Air-entrained |

TABLE-continued

| No-fines concrete | Groups of lightweight concrete: Lightweight aggregate concrete | Aerated concrete | |
|---|---|---|---|
| fuel ash | | bleaching powder method | foam |
| (5) Expanded clay or shale | (5) Expanded slate | | |
| (6) Expanded slate | (6) Sintered pulverized fuel ash | | |
| (7) Foamed slag | (7) Exfoliated vermiculite | | |
| | (8) Expanded perlite | | |
| | (9) Pumice | | |
| | (10) Organic aggregates | | |

Lightweight concrete as described above may be used to cover the surface of normal dense concrete used to fabricate the said wall or dam or to cover the ground of the said collecting space formed within or the lightweight concrete may be used as the structural material from which the whole structure is made.

As stated above a wide variety of heat insulating materials are available but may not be suitable for use on the surfaces of the wall or dam or on the ground of the collecting space considered in the context of the present invention. It will be understood, however, that although they may be unsuitable for use as the surface materials the use of any of these materials as a backing to the lightweight concrete material is not precluded.

In a preferred embodiment to counter any tendency of the said lightweight concrete material because of its relatively porous nature, to absorb water from the underlying ground or other material or to be wetted by rainfall, the surface(s) of the said lightweight concrete material is coated with a layer of water-repellent or water-resistant material, such as an epoxy resin. Examples of such surface coatings which may be applied in very thin layers e.g. 0.01–10 MM thickness are "Eponite clear sealer" and "Eponite G 23" (both manufactured by Shell Composites Ltd).

An example of a suitable lightweight concrete is a concrete wherein the normally dense aggregate material has been wholly or partly replaced by pieces of expanded clay. If desired the sand normally employed in this lightweight concrete may be replaced by the fine powder produced by the comminution of pieces of expanded clay.

The invention will now be described further with reference to the accompanying drawings.

Referring to FIG. 1, a tank 1 for the storage of liquefied gas 2 is surrounded by a wall or dam 3 in such a manner that a collecting space 4 is formed around the tank 1. The surface of the ground 5 inside the collecting space 4 is designated by the numeral 6, and the surface of the wall or dam 3 inside the collecting space 4 is designated by the numeral 7. The two surfaces 6 and 7 are provided with a cover which is generally indicated by the reference numeral 8.

This cover 8 may consist of a single layer of lightweight concrete 9 applied on the surfaces 6 and 7 as shown in FIG. 2.

In the embodiment as shown in FIG. 3, the cover 8 comprises a layer of normal concrete 10 applied on the surfaces 6 and 7 and a layer of lightweight concrete 9 applied on top of the layer of dense concrete 10.

In the embodiment as shown in FIG. 4 a layer of normal dense concrete 10 is applied on the surfaces 6 and 7, a layer of water-repellent material (damp proofing), for example, epoxy resin 11 is applied on top of the dense concrete 10, a layer of lightweight concrete 9 is applied on the layer 11 and a further layer of water-repellent material, for example, epoxy resin 12 is applied on the upper surface of the lightweight concrete 9.

Referring to FIG. 5, a tank 20 for the storage of liquefied gas 21 is partially sunk into the ground 22 and bedded on a raft 23 of normal dense concrete. The tank 20 is surrounded by a wall or dam 24 built of lightweight concrete situated in close proximity to the tank 20 and defining a collecting space 25, the base 26 of which is also of lightweight concrete. The use of the wall or dam 24 close to the tank 20 produces a collecting space 25 with dimensions such that if any spillage of liquefied gas occurs into it the vaporization is less rapid than with an open space as shown in FIG. 1 and a less concentrated cloud of vapor is produced. By fabricating the wall or dam 24 from lightweight concrete as discussed the amount of heat available in the case of accidental spillage is still further reduced. If preferred the whole of the raft 23, the wall or dam 24 and the base 26 of the collecting space 25 may be made from normal dense concrete and the inner faces thereof insulated by a layer of lightweight concrete.

What is claimed is:

1. In an installation for the storage of liquefied gas, comprising a tank surrounded by collecting means selected from the group consisting of a wall and a dam which together with the enclosed ground forms a collecting space around the tank the improvement comprising that the surface of the ground of the collecting space and said collecting means comprises a layer of heat-insulating material consisting of lightweight concrete material having a density in the range from about 32 kg per cubic meters to 1840 kg per cubic meter.

2. The installation as in claim 1, wherein the surface of the lightweight concrete material is covered with a layer of an epoxy resin material.

3. The installation as in claim 1 wherein the surface of said ground comprises a layer of lightweight concrete material applied on normal dense concrete material.

* * * * *